United States Patent [19]

Missalla

[11] Patent Number: 4,877,210

[45] Date of Patent: Oct. 31, 1989

[54] POT HANGER

[76] Inventor: Manfred F. Missalla, 52 Shieldmark Crescent, Thornhill, Ontario, Canada, L3T 3T5

[21] Appl. No.: 301,490

[22] Filed: Jan. 26, 1989

[30] Foreign Application Priority Data

Apr. 26, 1988 [CA] Canada ..... 565121

[51] Int. Cl.[4] ..... A47H 1/10

[52] U.S. Cl. ..... 248/318; 47/67

[58] Field of Search ..... 248/213.2, 215, 218.1, 248/218.2, 221.3, 303, 318, 339, 340, 302; 47/67

[56] References Cited

U.S. PATENT DOCUMENTS

| | | | |
|---|---|---|---|
| 225,020 | 3/1880 | Pettengill | 248/318 |
| 736,030 | 8/1903 | Scott . | |
| 792,905 | 6/1905 | Kirchner . | |
| 858,840 | 7/1907 | Van Leeuwen, Jr. . | |
| 1,334,199 | 3/1920 | Weiseman | 47/67 |
| 1,369,965 | 3/1921 | Comstock | 47/67 |
| 1,443,022 | 1/1923 | Hielscher . | |
| 1,572,548 | 2/1926 | Mattison | 47/67 |
| 2,452,826 | 11/1948 | Backs . | |
| 3,547,392 | 12/1970 | Tanzer | 248/340 |
| 3,891,176 | 6/1975 | Downing et al. . | |
| 3,943,661 | 3/1976 | DeVito | 47/67 |
| 4,059,920 | 11/1977 | Worrell | 47/67 |
| 4,084,779 | 4/1978 | Moineau . | |
| 4,138,803 | 2/1979 | Sherlock | 47/67 |
| 4,147,320 | 4/1979 | Biedebach . | |
| 4,235,407 | 11/1980 | Haas | 47/67 |
| 4,385,742 | 5/1983 | Rocquin | 248/318 |
| 4,440,371 | 4/1984 | Wijsman | 248/318 |
| 4,592,166 | 6/1986 | Tendrup | 47/67 |

FOREIGN PATENT DOCUMENTS

| | | | |
|---|---|---|---|
| 1200371 | 7/1970 | United Kingdom | 47/67 |

*Primary Examiner*—Blair M. Johnson
*Assistant Examiner*—Robert A. Olson

[57] ABSTRACT

A hanger for pots of the type having a plurality of openings spaced around a perimeter and having a suspension member, a plurality of wires connected to the suspension member, and on the other of ends of each wire there being a quick attachment device adapted to be inserted through a respective opening in the pot, and engaging the pot securely.

1 Claim, 1 Drawing Sheet

POT HANGER

Figure 1:
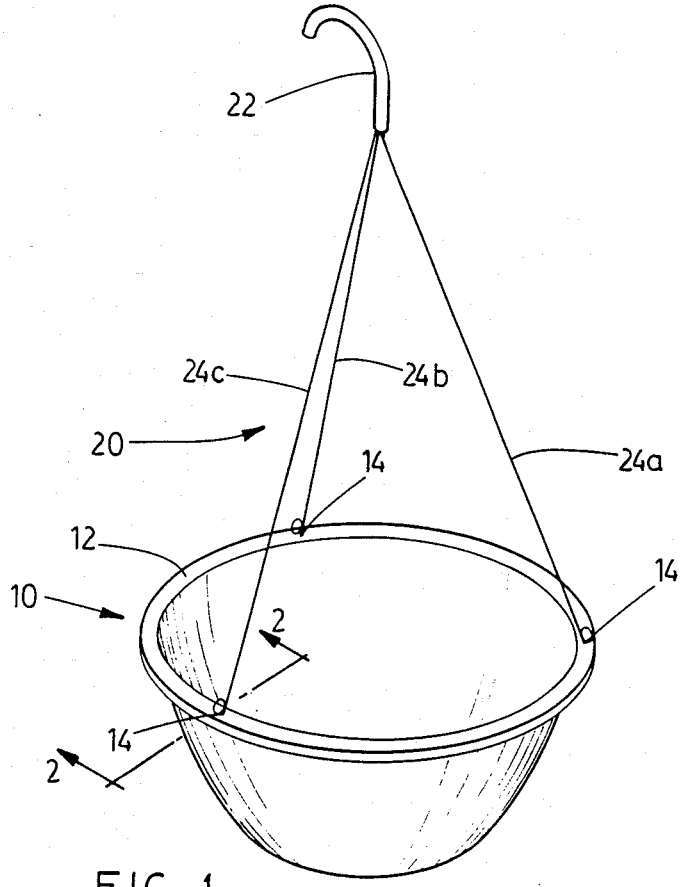

The invention relates to a hanger for pots, such as flower pots, and in particular to a hanger which is quickly attachable to such a pot.

BACKGROUND OF THE INVENTION

Hanging pots, such as pots for containing plants and flowers, are frequently provided with hangers by means of which the pots may be hung for better effect. The typical hanging pot has three holes equally spaced around its perimeter. The hanger usually consists of three strands of wire, having their upper ends joined to a hook. The lower ends of the wires are simply threaded through the holes and twisted around to secure them in position.

Hangers of this kind are in very wide use and have proved entirely satisfactory for the purpose. However, the practice in the industry for assembling the pots and hangers usually involves considerable manual labour, performing the task of connecting the three wires to each pot. As labour costs increase, the cost of this manual labour becomes a significant factor.

In addition to the expense of manual labour, it is found that in some cases the attachment of the hanger to the pot simply by manually twisting the wire around, does not always result in a hanger in which all three pieces of wire are of equal length. Consequently the pot may hang somewhat lop-sided, or one piece of wire may require re-adjustment.

For all of the these reasons it is therefore desirable to provide a pot hanger wherein the requirement for manual labour in attaching it to a pot is reduced to a minimum, and furthermore in which the possibility of unequal attachment of the hanger to the pot is substantially eliminated.

BRIEF SUMMARY OF THE INVENTION

With a view to overcoming the various disadvantages noted above, the invention comprises a hanger for pots, of the type having a plurality of opening spaced around a perimeter and having a suspension member, a plurality of wires, said wires being connected to one of their ends to said suspension member, and the other of said ends of each said wire having a quick attachment device, said quick attachment device being adapted to be inserted through a respective said opening, and engaging said pot securely.

More particularly, it is an objective of the invention to provide a hanger for pots having the foregoing advantages wherein said quick attachment device comprises a finger formed on the end of each said wire, said finger being bent at an acute angle to said wire, said finger and said wire being resiliently flexible towards and away from one another, whereby to facilitate insertion of said device through a said opening.

More particularly, it is an objective of the invention to provide a hanger for pots having the foregoing advantages, and including a stop portion formed in said wire spaced from said finger, said stop portion being incapable of passing through said opening.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and describrd preferred embodiments of the invention.

IN THE DRAWINGS

Figure 2:
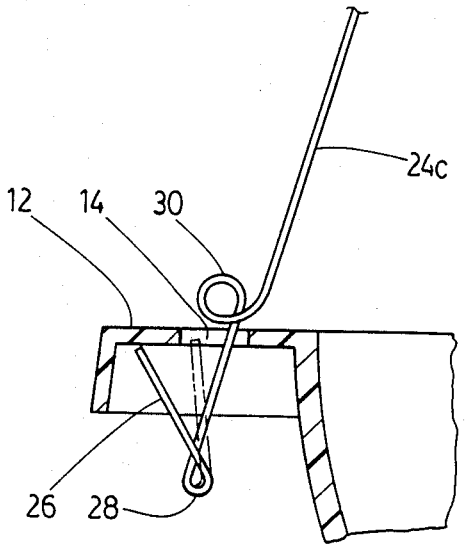

FIG. 1 is a perspective illustration showing a typical pot for supporting flowers or the like, and provided with a pot hanger according to one embodiment of the invention; and, FIG. 2 is a section of a portion of a pot hanger along the line 2—2 of FIG. 1, showing movement thereof in phantom.

Referring first of all to FIGS. 1 and 2, this embodiment of the invention will be seen to be illustrated in association with a typical pot indicated generally as 10. The pot 10 as illustrated is in the form of a generally semi-spherical bowl. It will of course be appreciated however, that pots for hanging flowers and other objects may be made in any of a variety of shapes, without departing from the scope of the invention. Typically such a pot will have a peripheral flange 12. However, not all such pots are formed with peripheral flanges. Some pots simply define a peripheral edge, which is not illustrated here since it is in any event well known.

Hanging pots of this type are in the great majority of cases provided with openings 14 around the periphery, for the purpose of attaching pot hangers. Such openings may be small circular openings, as shown in the embodiment of FIG. 1. In other cases, openings of different sizes and shapes and the invention is not confined soley to pots having openings of the type illustrated.

The pot hanger illustrative of this embodiment of the invention is indicated generally as 20. It comprises a suspension member, in this case a hook 22, and three wires 24*a*, 24*b*, and 24*c*.

It will, of course, be appreciated that while the hook, and three wires are illustrated, and are in fact the most typical form of pot hanger, conceivably other suspension means and more such wires might be provided in some cases.

On the free end of each of the wires, there is provided a quick attachment device. In this embodiment of the invention the quick attachment device consists of a finger 26, joined to the wire at an acute angle by loop 28. In accordance with the objective of the invention it is desirable to provide such an acute angle in the form of a loop, as shown so that the finger 26 extends diagonally across the axis of the wire frame one side to the other. The loop, in this embodiment, will preferably be of generally circular shape, having a predetermined diameter such that it is capable of being slipped through an opening 14 in the pot 10.

In addition, the use of a generally circular loop to provide such an acute angle bend provides the wire finger with a degree of resilient flexibility, such that it can flex inwardl against the wire, and thus facilitate insertion through an opening in a pot.

Preferably, in accordance with the invention, each wire is further provided with an abutment or stop member indicated generally as 30. In this embodiment of the invention such an abutment consists of a generally circular loop formed in the wire.

It will however be appreciated that such an abutment could be formed in a variety of different ways and with different shapes, while achieving the same result.

The abutment is sized so that it will not pass through the opening in the pot.

In operation, in order to assemble the pot hanger with a pot as shown in FIG. 1, each of the three fingers and their associated loops are simply slipped through respective openings in the pot. As they pass through, the fingers will flex inwardly against the wires. As the fingers flex inwardly their loops will tend to expand slightly as shown in phantoms in FIG. 2. Once through the openings the fingers will, and then spring out once more.

The abutments will prevent the wires from slipping too far through the opening, and thus facilitate carrying.

It will thus be seen that the quick attachment device in accordance with the invention provides for ease of assembly, and provides a secure mode of attachment.

In addition, the problem of ensuring that each of the wires is of the same length, is eliminated.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A hanger for pots of the type having a plurality of openings spaced around a perimeter and comprising:

a suspension member;

a plurality of wires, said wires being connected at one end of their ends to said suspension member;

a finger formed on the other end of each said wire, each said finger being bent at an acute angle to said wire;

a generally circular loop formed at the junction between said wire and said finger, said finger extending from one side of said wire to the opposite side of said wire, said loop being resiliently flexible permitting said finger to flex inwardly against said wire, flexing of said wire and said finger towards one another causing partial expansion of said loop whereby to facilitate insertion of said wire said finger and said loop through a said opening, and, a stop portion formed in said wire spaced from said finger, said stop portion being incapable of passing through said opening.

* * * * *